US009113722B1

(12) United States Patent
Ueno

(10) Patent No.: US 9,113,722 B1
(45) Date of Patent: Aug. 25, 2015

(54) WAIST-MOUNTED BABY HARNESS

(71) Applicant: Mariko Ueno, Elizabeth, NJ (US)

(72) Inventor: Mariko Ueno, Elizabeth, NJ (US)

( * ) Notice: Subject to any disclaimer, the term of this patent is extended or adjusted under 35 U.S.C. 154(b) by 59 days.

(21) Appl. No.: 14/172,628

(22) Filed: Feb. 4, 2014

(51) Int. Cl.
*A47D 13/02* (2006.01)

(52) U.S. Cl.
CPC ..... *A47D 13/025* (2013.01)

(58) Field of Classification Search
CPC .... A47D 13/025; A47D 13/02; A47D 13/046
USPC ..... 224/159, 160, 161
See application file for complete search history.

(56) References Cited

U.S. PATENT DOCUMENTS

| | | | | |
|---|---|---|---|---|
| 2,411,331 | A * | 11/1946 | Nettleship | 224/159 |
| 3,575,326 | A * | 4/1971 | Chappell | 224/159 |
| 4,750,653 | A * | 6/1988 | Prunty | 224/159 |
| 4,901,898 | A | 2/1990 | Colombo et al. | |
| 4,981,110 | A * | 1/1991 | Llewellyn | 119/770 |
| 5,011,056 | A | 4/1991 | Larreategui | |
| 5,224,637 | A | 7/1993 | Colombo | |
| 5,492,256 | A | 2/1996 | Ive | |
| 5,711,466 | A | 1/1998 | Kataoka et al. | |
| 5,813,580 | A | 9/1998 | Fair | |
| 5,926,846 | A * | 7/1999 | Segal | 2/102 |
| 6,836,902 | B2 * | 1/2005 | Marquez et al. | 2/69 |

* cited by examiner

*Primary Examiner* — Brian D Nash
*Assistant Examiner* — Corey Skurdal
(74) *Attorney, Agent, or Firm* — Thomas J. Germinario

(57) ABSTRACT

A baby harness is designed to concentrate the infant's weight on the waist and hips rather than on the neck and shoulder area, which is typical of conventional baby harnesses. This design enables the parent to remain active in terms of being hands-free and allowing bending from the waist. The harness secures the baby to the parent's lower back/waist/buttocks area by two cooperating tapered belt components which are extensions of the harness itself. The seat component of the harness comprises a concave enclosure providing bottom, back and head support. The seat component has bilateral extensions containing four openings through which the infant's arms and legs project, thereby securing both the upper and lower body of the child while also allowing free movement of the baby's limbs. The bilateral extensions taper toward the front of the harness and transition into the two cooperating belt components that connect around the parent's waist, so that the belt also contributes to stabilizing the infant's body weight distribution.

5 Claims, 2 Drawing Sheets

WAIST-MOUNTED BABY HARNESS

FIELD OF INVENTION

The present invention relates to the field of carriers and harnesses which are attachable to the body of an adult and are used for transporting infants and small children. More particularly, the present invention relates to a baby harness which is configured so as not to restrict the upper body movements of the adult to whom it is strapped.

BACKGROUND OF THE INVENTION

The demands of modern living increasingly require adults to carry infant children with them as they engage in daily activities, such as shopping, housekeeping and gardening. Since such activities often involve use of the arms and bending from the waist, existing baby carriers and harnesses which require shoulder straps and concentrate the child's weight on the adult's upper body are unduly restrictive of the adult's upper body mobility.

The present invention aims to address this deficiency by providing a baby harness that does not require shoulder straps, but which rather uses the adult's waist and lower body to bear the infant's weight, thereby enabling much freer movement of the adult's arms and upper body. By concentrating the harness weight in the adult's waist area, this design provides for a closer alignment of the centers of gravity of the child and the adult, thereby minimizing torques which would otherwise impede bending and turning of the adult's upper body. This design also eliminates strain on the adult's shoulder, neck and back, as well as the pain associated with such strain. Moreover, the harness of the present invention completely envelopes and secures the infant's body and supports his/her back and head, while at the same time allowing free movement of the baby's arms and legs.

SUMMARY OF THE INVENTION

The baby harness of the present invention is designed to concentrate the infant's weight on the waist and hips rather than on the neck and shoulder area, which is typical of conventional baby harnesses. This design enables the parent to remain active in terms of being hands-free and allowing bending from the waist. The harness secures the baby to the parent's lower back/waist/pelvis area by two cooperating tapered belt components which are extensions of the harness itself. The seat component of the harness comprises a concave enclosure providing bottom, back and head support. The seat component has bilateral extensions containing four openings through which the infant's arms and legs project, thereby securing both the upper and lower body of the child while also allowing free movement of the baby's limbs. The bilateral extensions taper toward the front of the harness and transition into the two cooperating belt components that connect around the parent's waist, so that the belt also contributes to stabilizing the infant's body weight distribution.

As used in the detailed description and claims which follow, the terms "upper" and "lower" are respectively defined in relation to the directions of the upper portions of the human body (e.g., toward the head) and the lower portion of the human body (e.g., toward the feet), while the terms "front" and "back" are respectively defined in relation to the directions of the frontal side of the human body (e.g., toward the face) and the rear of the human body (e.g., toward the spine).

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
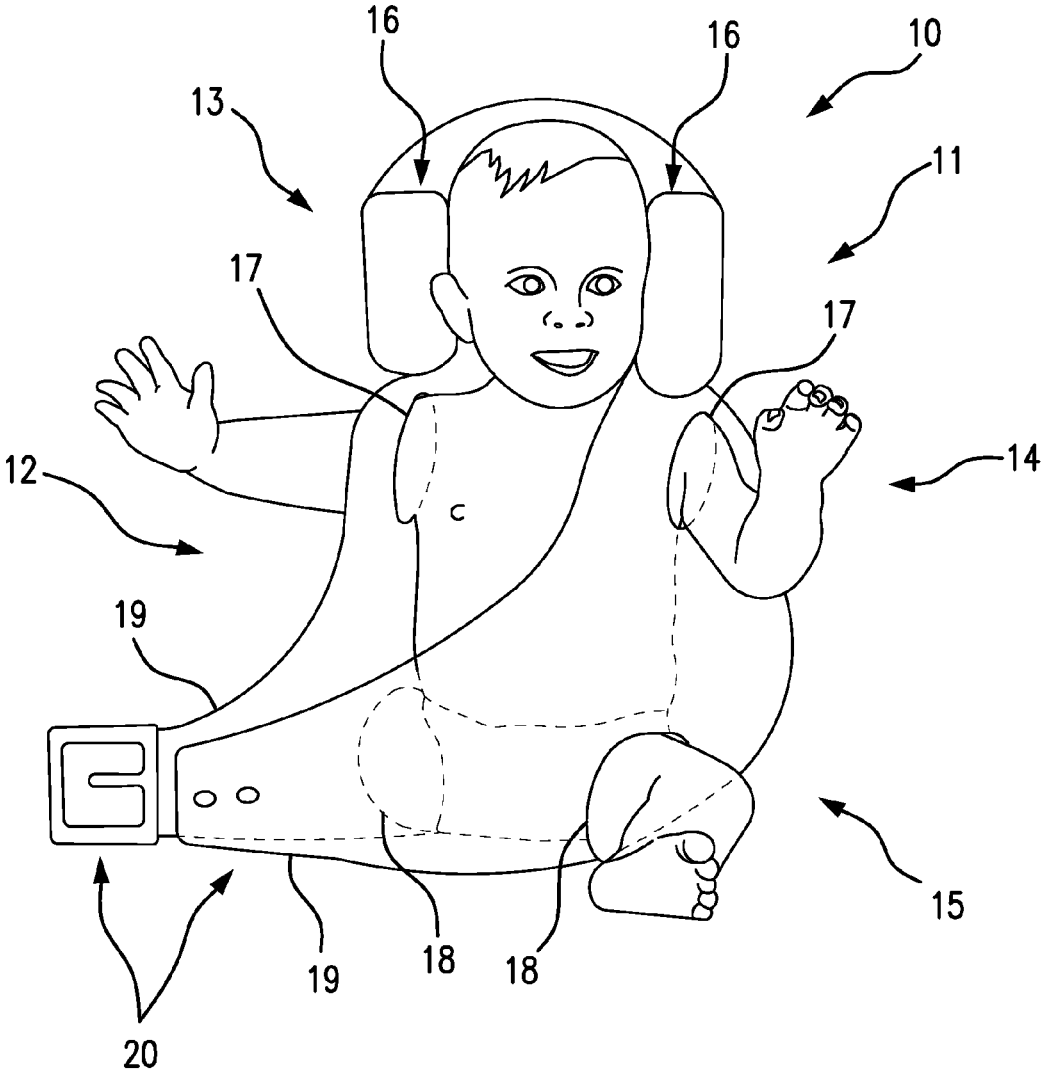
FIG. 1 is a perspective view of the waist-mounted baby harness, in accordance with the preferred embodiment of the present invention.
Figure 2:
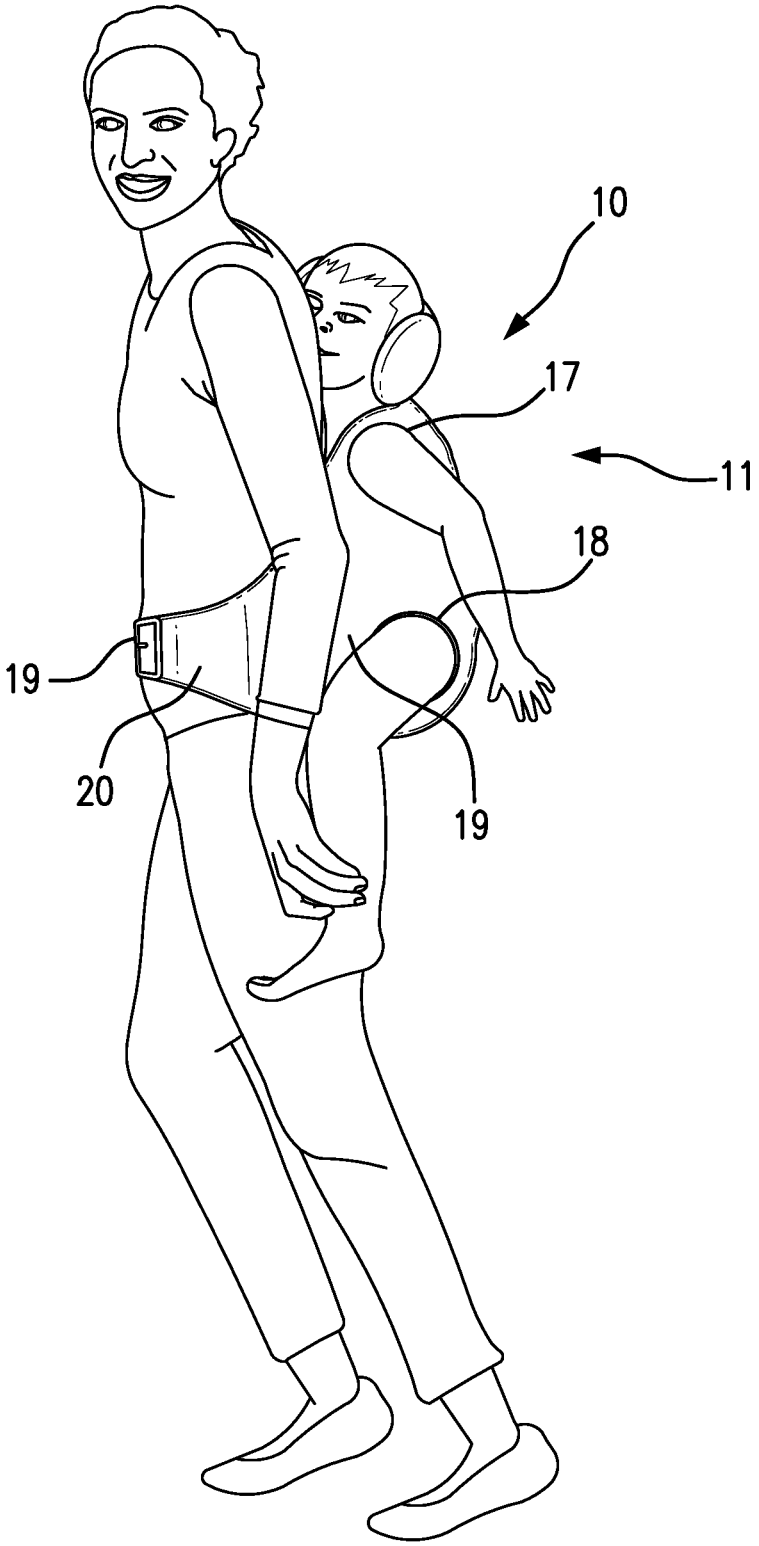
FIG. 2 is a perspective view of the baby harness of FIG. 1 worn by an adult.

Referring to FIGS. 1 and 2, one embodiment of the waist-mounted baby harness 10 comprises a semi-rigid, generally concave harness shell 12, fabricated as an integral continuous sheath, which defines a generally hemispherical infant enclosure 12, which wraps around the infant's head, neck and torso. The infant enclosure 12 comprises an upper head support 13, a medial torso support 14 and a lower seat support 15. The head support 13 contains bilateral adjustable head restraints 16, so that the infant's head is restrained in back by the harness shell 12, on either side by the head restraint 16, and in front by the back of the adult's torso.

The torso support 14 has bilateral upper limb supports 17, which are configured to receive the infant's arms so that the arms extend through the harness shell 11 and outside the infant enclosure 12. The seat support 15 has bilateral lower limb supports 18, which are configured to receive the infant's legs, so that the legs extend through the harness shell 11 and outside the infant enclosure 12.

The harness shell 12 has bilateral tapered belt extensions 19, which are configured to wrap around the adult's waist and hips from the back and close together, in the area of the adult's waist and hips, secured by an adjustable belt closure 20, such as a buckle, a catch or cooperating hook-and-loop strips. With the belt extensions 19 secured around the adult's waist/hips, as shown in FIG. 2, the infant is supported along the adult's back, waist, pelvis and/or buttocks area, such that the adult's hands remain free, his/her shoulders are unburdened of straps, and the baby's weight does not impede the adult's upper body mobility, including bending from the waist.

While the preferred embodiment of the present invention has been illustrated herein with the harness 10 being attached so that the infant is carried in back of the adult's torso, it should be understood that the harness 10 can alternately be attached so that the baby is carried on the side or in front of the adult's torso.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A harness for carrying a baby in a waist area of a torso of an adult, the harness comprising:

a substantially hemispherical harness shell, comprising an integral, continuous sheath of semi-rigid material, which wraps around and supports the baby's head, neck and torso within a substantially hemispherical infant enclosure defined by the harness shell;

wherein the harness shell further comprises two bilateral upper limb supports, through which the baby's arms extend, and two bilateral lower limb supports, through which the baby's legs extend, so that the baby's limbs are free to move outside the harness shell;

wherein the harness shell further comprises two bilateral belt extensions, which wrap around the waist area of the adult's torso in a substantially horizontal orientation and adjustably close together, by means of an adjustable belt closure, in the waist area of the adult's torso, thereby supporting the baby in the harness in the waist area of the adult's torso in a substantially vertical orientation parallel to the adult's torso, with the two bilateral upper limb supports laterally disposed on either side of the adult's torso and the two bilateral lower limb supports laterally disposed on either side of the adult's torso, without the use of straps or other supporting means extending from the upper torso of the adult.

2. The harness of claim 1, wherein the infant enclosure comprises an upper head support section, a medial torso support section, and a lower seat support section.

3. The harness of claim 2, wherein the upper limb supports are located in the torso support section.

4. The harness of claim 2, wherein the lower limb supports are located in the seat support section.

5. The harness of claim 2, wherein the head support section supports and restrains the back of the baby's head and contains bilateral adjustable head restraints, which restrain the baby's lateral head movements.

* * * * *